US008500611B2

(12) United States Patent
Hoffman

(10) Patent No.: US 8,500,611 B2
(45) **Date of Patent: *Aug. 6, 2013**

(54) DUAL TRACK EXERCISE DEVICE

(75) Inventor: Jonathan Hoffman, Herzelia Pituach (IL)

(73) Assignee: Balanced Body, Inc., Sacramento, CA (US)

( * ) Notice: Subject to any disclaimer, the term of this patent is extended or adjusted under 35 U.S.C. 154(b) by 589 days.

This patent is subject to a terminal disclaimer.

(21) Appl. No.: 12/162,750

(22) PCT Filed: Nov. 29, 2006

(86) PCT No.: PCT/US2006/045615

§ 371 (c)(1),
(2), (4) Date: Oct. 30, 2008

(87) PCT Pub. No.: WO2007/087007

PCT Pub. Date: Aug. 2, 2007

(65) Prior Publication Data

US 2009/0098983 A1 Apr. 16, 2009

(30) Foreign Application Priority Data

Jan. 30, 2006 (IL) ..... 173449
Jan. 30, 2006 (IL) ..... 173450

(51) Int. Cl.
*A63B 21/02* (2006.01)
*A63B 21/04* (2006.01)

(52) U.S. Cl.
USPC ..... 482/123; 482/129

(58) Field of Classification Search
USPC ..... 482/70, 71, 79, 121–123, 129–130, 482/51, 52, 96, 133, 146, 147, 907
See application file for complete search history.

(56) References Cited

U.S. PATENT DOCUMENTS

| | | | | |
|---|---|---|---|---|
| 3,559,986 | A * | 2/1971 | Ehrmantraut | 482/70 |
| 3,582,069 | A * | 6/1971 | Flick et al. | 482/70 |
| 3,641,601 | A * | 2/1972 | Sieg | 5/420 |
| 4,402,506 | A * | 9/1983 | Jones | 482/70 |
| 4,512,571 | A * | 4/1985 | Hermelin | 482/70 |
| 4,679,786 | A * | 7/1987 | Rodgers | 482/70 |

(Continued)

FOREIGN PATENT DOCUMENTS

| | | | |
|---|---|---|---|
| FR | 1486082 | | 6/1967 |
| FR | 2615111 | A * | 11/1988 |
| GB | 2031740 | A * | 4/1980 |
| WO | WO 99/20352 | | 4/1999 |

OTHER PUBLICATIONS

SRF Board (Stabilization, Rotation and Function) from Fitter First, retrieved online on Feb. 22, 2009, at: http://www.fitter1.com/Catalog/Items/SRF.aspx.

(Continued)

*Primary Examiner* — Stephen Crow
(74) *Attorney, Agent, or Firm* — Greenberg Traurig LLP

(57) ABSTRACT

A portable device for performing exercises, including: two independent tracks with a physical connection between them, and a movable platform on each track. The device is adapted to enable a user to move the movable platform on both tracks simultaneously by exerting a physical force on each platform simultaneously, and the physical force required to move each platform by the same distance is independently controllable for each platform.

26 Claims, 9 Drawing Sheets

(56) References Cited

U.S. PATENT DOCUMENTS

| | | | | | |
|---|---|---|---|---|---|
| 4,706,593 | A | * | 11/1987 | Vail, Jr. | 114/211 |
| 4,706,953 | A | | 11/1987 | Graham | |
| 4,709,953 | A | * | 12/1987 | Sirota | 294/106 |
| 4,781,372 | A | * | 11/1988 | McCormack | 482/70 |
| 4,884,802 | A | | 12/1989 | Graham | |
| 5,042,797 | A | | 8/1991 | Graham | |
| 5,066,005 | A | * | 11/1991 | Luecke | 482/96 |
| 5,279,530 | A | * | 1/1994 | Hess | 482/70 |
| 5,295,935 | A | * | 3/1994 | Wang | 482/130 |
| 5,342,264 | A | | 8/1994 | Gordon | |
| 5,429,567 | A | * | 7/1995 | Gerschefske et al. | 482/70 |
| 5,499,957 | A | | 3/1996 | Metcalf et al. | |
| 5,499,958 | A | * | 3/1996 | Hess | 482/79 |
| 5,520,598 | A | * | 5/1996 | Little | 482/79 |
| 5,620,403 | A | | 4/1997 | Lundin | |
| D387,107 | S | * | 12/1997 | Yang | D21/668 |
| 5,769,755 | A | | 6/1998 | Henry et al. | |
| 5,807,211 | A | | 9/1998 | Berryhill | |
| 5,879,275 | A | | 3/1999 | Aruin | |
| 6,042,511 | A | * | 3/2000 | Bulloch | 482/51 |
| 6,042,523 | A | * | 3/2000 | Graham | 482/121 |
| 6,338,704 | B1 | | 1/2002 | Endelman | |
| 6,663,540 | B1 | | 12/2003 | Huang | |
| 6,672,994 | B1 | | 1/2004 | Stearns et al. | |
| 6,676,576 | B1 | * | 1/2004 | Wu | 482/126 |
| 6,733,428 | B2 | | 5/2004 | List | |
| 6,837,838 | B2 | * | 1/2005 | List | 482/147 |
| 6,840,894 | B2 | | 1/2005 | Lerner | |
| 6,926,646 | B1 | | 8/2005 | Nguyen | |
| 6,926,650 | B2 | * | 8/2005 | Endelman et al. | 482/121 |
| 6,981,932 | B1 | | 1/2006 | Huang et al. | |
| 7,288,053 | B2 | | 10/2007 | Endelman et al. | |
| 7,322,908 | B2 | | 1/2008 | DiGiacomo | |
| D623,244 | S | * | 9/2010 | Hoffman | D21/668 |
| 7,931,570 | B2 | * | 4/2011 | Hoffman | 482/123 |
| 2001/0036885 | A1 | * | 11/2001 | Castellot et al. | 482/79 |
| 2002/0132706 | A1 | | 9/2002 | Sleamaker | |
| 2003/0171190 | A1 | | 9/2003 | Rice | |
| 2003/0216230 | A1 | * | 11/2003 | Wang | 482/123 |
| 2004/0053752 | A1 | * | 3/2004 | Yang | 482/70 |
| 2005/0043151 | A1 | | 2/2005 | Geeting et al. | |
| 2006/0058164 | A1 | * | 3/2006 | Miller et al. | 482/87 |

OTHER PUBLICATIONS

International Search Report and Written Opinion from corresponding International Application No. PCT/US2006/045615.

International Search Report and Written Opinion from related International Application No. PCT/US2006/045772, mailed Oct. 5, 2007.

Supplemental European Search Report and Preliminary Examination Report from related European Patent Application No. 06844651.7, dated Apr. 6, 2010.

Office Action, dated Aug. 12, 2010, from co-owned European Patent Application No. 06844651.7.

* cited by examiner

FIG. 9A
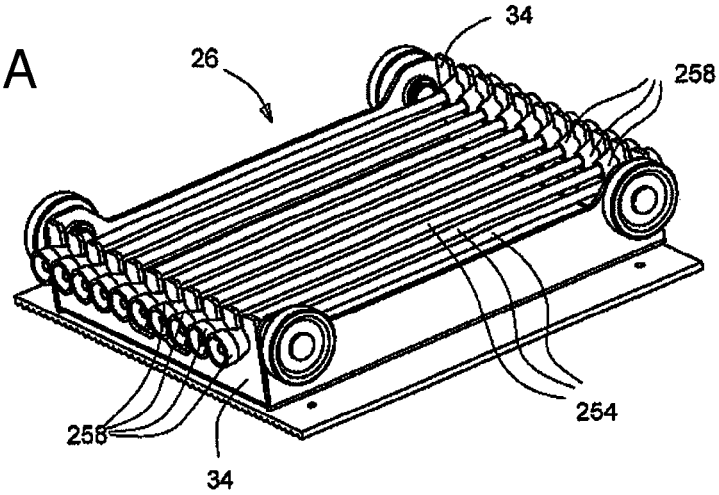
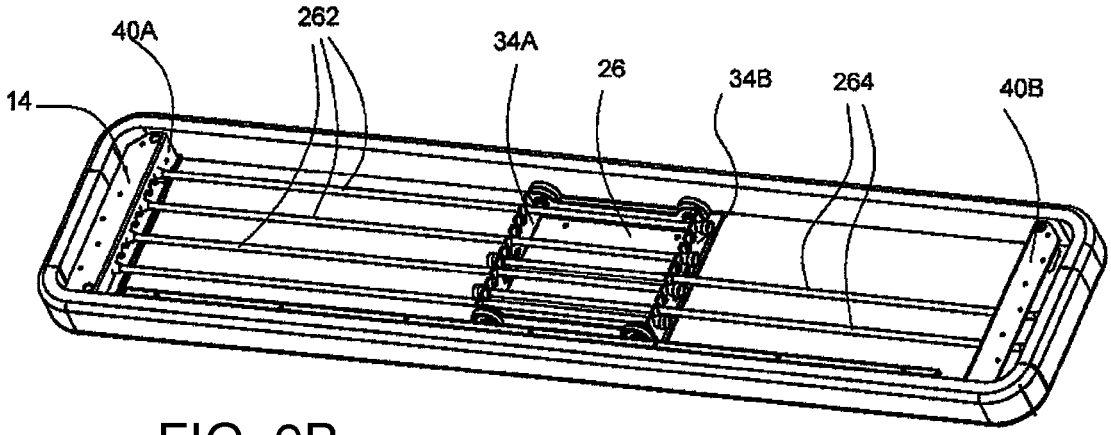
FIG. 9B
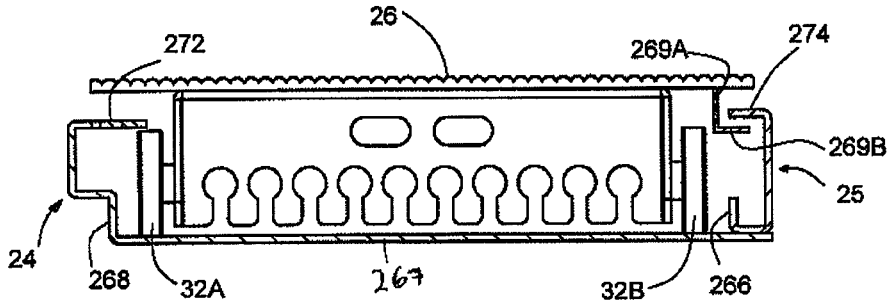
FIG. 9C

DUAL TRACK EXERCISE DEVICE

CROSS-REFERENCE TO RELATED APPLICATIONS

This application is a U.S. national stage filing under 35 U.S.C. 371 of International Application No: PCT/US2006/045615, filed on Nov. 29, 2006, which claims priority to Israeli Patent Application No. 173449, filed on Jan. 30, 2006, and to Israeli Patent Application No. 173450, filed on Jan. 30, 2006. This application is related to U.S. patent application Ser. No. 12/162,761, filed Jul. 30, 2008, which is a US national stage filing under 35 U.S.C. 371 of International Application No. PCT/US2006/04772 filed Nov. 29, 2006. The entire teachings of the referenced Applications are incorporated herein by reference.

FIELD OF THE INVENTION

The present invention relates generally to an apparatus and method for performing exercise, and specifically an exercise device with a track and a platform that moves on the track.

BACKGROUND OF THE INVENTION

Many exercise devices are marketed, for example treadmills and ski simulators. Some exercise devices are lightweight and small in size so they can be considered portable. Other exercise devices are large or heavy such that a user cannot easily transport them from place to place.

Typically an exercise device is used to assist in performing exercise, for example by making it more fun and/or by helping to train specific muscles or to perform a specific motion. Some devices are used for rehabilitation of a person with injury and others to strengthen specific muscles.

Some devices use an elongated track with a platform that can move back and forth across the track, for example a SRF Board as sold by FitterFirst (www.fitter1.com). Typically, the user forms physical contact with the platform and causes it to move back and forth across the track, for example by standing on the platform with one leg and placing the other leg on the floor or holding on to an external stationary support.

U.S. Pat. No. 5,342,264 to Gordon describes an aerobic exercise device that provides for a smooth, natural, orbital continuous motion of the user's feet. In Gordon there is provided two parallel tracks with platforms. The platforms are controlled similarly to enable a user to jog, run, walk and perform other coordinated motion.

SUMMARY OF THE INVENTION

An aspect of an embodiment of the invention relates to an exercise device comprising two independent tracks, which are fixed in position relative to each other. Each track accepts one or more platforms which move with a controllable constraint on the track. Optionally, one platform can be set to require a large force to be moved while the platform on the second track may be set to require less force.

In an exemplary embodiment of the invention, the motion of a single platform does not directly affect the motion of other platforms on the same track or on the other track.

In some embodiments of the invention, the two tracks are of the same length. Alternatively or additionally, the tracks differ in length. In some embodiments of the invention, the tracks are positioned parallel to each other. Alternatively, the tracks are situated at an angle relative one to the other. In some embodiments of the invention, the tracks are positioned such that they have a common beginning. Alternatively the tracks are positioned with an offset between the beginnings of each other on the longitudinal axis.

In some embodiments of the invention, the two tracks are encased in a common frame that holds them in position together. Alternatively, each track is held in its own frame and the frames are joined together.

In some embodiments of the invention, a grip material is adhesively attached under the frame in order to prevent slippage of the device during use.

There is thus provided according to an exemplary embodiment of the invention, a portable device for performing exercises, including: two independent tracks with a physical connection between them, a movable platform on each track, wherein the device is adapted to enable a user to move the movable platform on both tracks simultaneously by exerting a physical force on each platform simultaneously; and wherein the physical force required to move each platform by the same distance is independently controllable for each platform. In an exemplary embodiment of the invention, the tracks are connected parallel to each other. Optionally, the tracks are connected with an offset between their starting points along their longitudinal axis. In some embodiments of the invention, the tracks have the same length. Alternatively, the tracks differ in length.

In some embodiments of the invention, the tracks form an angle greater than zero relative to each other. Optionally, the platforms are adapted to glide over the tracks. In some embodiments of the invention, the platforms comprise wheels to move on the tracks. Optionally, the platforms comprise gears to move on the tracks. In some embodiments of the invention, the device weighs less than 50 Kg. Optionally, the two tracks are not identical. In some embodiments of the invention, the two tracks differ in width. Optionally, the track length available to the platform to move on is selectable. In some embodiments of the invention, the track length available to the platform may be set to zero. Optionally, the device includes more than one platform on at least one track. In some embodiments of the invention, each track is encased in a frame. Optionally, the frame comprises a widened area that is wide enough for a user to place a foot. In some embodiments of the invention, the frames are connected together. Optionally, both tracks are encased in the same frame. In some embodiments of the invention, the device includes a connection apparatus to connect between the platform and the device to control the force required to move the platform. Optionally, the connection apparatus connects between the platform and one end of the device. In some embodiments of the invention, the connection apparatus connects between the platform and both ends of the device. Optionally, the connection apparatus includes multiple connectors.

BRIEF DESCRIPTION OF THE DRAWINGS

The present invention will be better understood and appreciated from the following detailed description taken in conjunction with the drawings. Identical structures, elements or parts, which appear in more than one figure, are generally labeled with a same or similar number in all the figures in which they appear, wherein:

FIG. 9A is a separate perspective view of the platform used in the disclosed invention shown in FIGS. 1 through 8 in an upside-down position, in accordance with a preferred embodiment.

FIG. 9B is a perspective view of a single frame and track device of the invention in an upside-down position showing the attached resistance mediums.

FIG. 9C is a lateral cross section through the track and the platform as shown in FIG. 8 and in FIG. 9B;

DETAILED DESCRIPTION OF THE INVENTION

Figure 1:
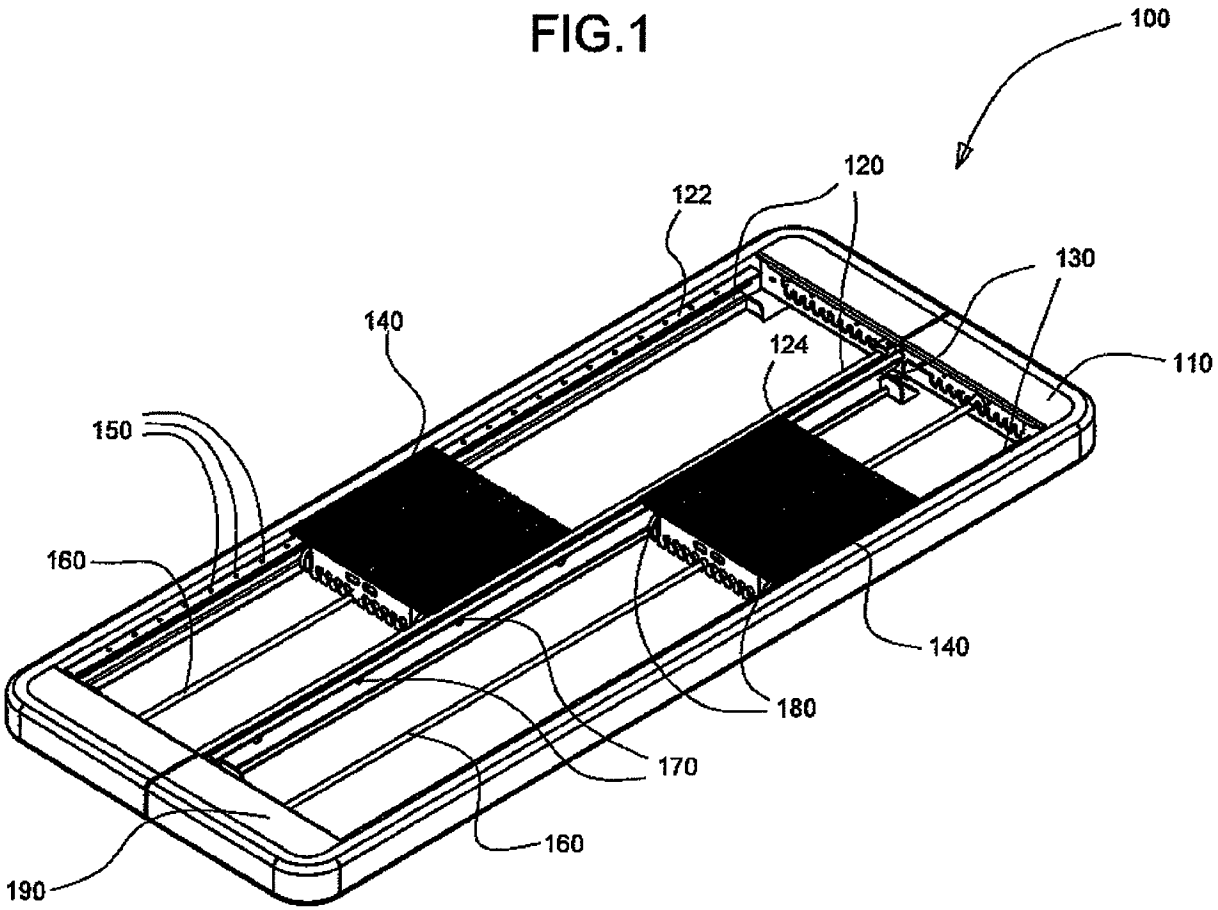
FIG. 1 is a schematic illustration of an exercise device with two tracks, according to an exemplary embodiment of the invention.

FIG. 1 is a schematic illustration of an exercise device 100 with two tracks (120,130), according to an exemplary embodiment of the invention. In an exemplary embodiment of the invention, tracks 120 and 130 are placed in a frame 110 to firmly support the tracks. In some embodiments of the invention, frame 110 is an open structure, for example metal bars welded together or pieces of wood. Alternatively or additionally, frame 110 includes an encasement enclosing tracks 120 and 130 from underneath and/or surrounding them from the sides.

In some embodiments of the invention, frame 110 is constructed from a material that induces friction (e.g. rubber) with common floor materials to prevent slippage during use. Alternatively or additionally, frame 110 may have attached supports or friction strips (e.g. from rubber or other materials) to prevent slippage.

In an exemplary embodiment of the invention, frame 110 includes a widened area 190 at one end of tracks 120, 130 or at both ends. Optionally, the widened area is large enough to allow a user to place a foot on widened area 190 while placing the other foot on platform 140. In some embodiments of the invention, the entire frame is wide enough to allow a user to place a foot on it.

In an exemplary embodiment of the invention, each track comprises two parallel rails (e.g. 122, 124) for accommodating a platform 140, which is adapted to travel on the track. In some embodiments of the invention, tracks 120, 130 may comprise more than two rails (e.g. 3 rails) or a single rail, for example supporting platform 140 through the middle. In an exemplary embodiment of the invention, platform 140 is adapted to glide over tracks (120, 130), for example using materials with a selected level of friction between them. In some embodiments of the invention, platform 140 comprises wheels 180 to control its motion across tracks 120, 130.

In an exemplary embodiment of the invention, platform 140 is connected by a connection device such as an elastic rope or spring 160 to frame 110 to introduce a controllable force opposing movement of platform 140. In an exemplary embodiment of the invention, multiple connection devices, of the same or varying strength, are available to the user to connect between platform 140 and frame 110 so that the user may control the force required to move platform 140. Optionally, platform 140 is connected to frame 110 on one side of the platform or on both sides of the platform. In some embodiments of the invention, platform 140 can be connected by a single rope or spring or by multiple ropes or springs on the same side or on opposite sides in order to allow the user to enlarge or reduce the force required to move platform 140. Optionally, by connecting more ropes or springs between platform 140 and frame 110 the force required to move platform 140 a specific distance is enlarged.

In some embodiments of the invention, track 120 (or 130) or frame 110 comprise limiting holes 150, which are use to limit the path by which platform 140 can move. Optionally, by inserting a peg through one of holes 150 the useable length of track 120 (or 130) is shortened. In some embodiments of the invention, the track length available for platform 140 to move on may be set to zero.

In an exemplary embodiment of the invention, device 100 is a portable device so that it can be relocated and positioned by a single person. Optionally, the length of device 100 is selected to conform to the dimensions of a typical user, between one to two meters and its width is selected to be between half a meter to a meter. However larger or smaller sizes may be selected for implementing device 100. In an exemplary embodiment of the invention, device 100 may be manufactured in various sizes to fit the needs of different users. Alternatively, a single size may be used by different users by adjusting the track length as described above. In some embodiments of the invention, the device is easily assembled and disassembled for ease of transport and deployment. In an exemplary embodiment of the invention, device 100 weighs less than 50 Kg so that it may be transported by a single person or with the help of a second person. Alternatively, each part of device 100 may weigh less than 50 Kg so that it can be disassembled and transported by a single person.

In an exemplary embodiment of the invention, frame 110 and tracks 120 and 130 are constructed from wood, metal, plastic or any other rigid material. Optionally, the material for constructing device 100 is selected according to the required strength and the desired weight.

In some embodiments of the invention, tracks 120 and 130 are contained in a single frame 110. Alternatively, each track may be contained in a separate frame and the two frames may be connected together along common points of contact, for example using connectors 170 to connect between two separate frames, each housing a single track. Optionally, connectors 170 may be screws, nuts and bolts, nails adhesives or other attachment devices.

In PCT application No. PCT/US2006/04772, filed by the applicant on the same date as the current application, the disclosure of which is incorporated herein by reference, there is described various embodiments for implementing an exercise device with a platform that moves freely or with a constraint on a single track. Optionally, a dual track exercise device may be formed by physically connecting two independent single track devices as described in the PCT application or connecting other single track devices with platforms as known in the art. In an exemplary embodiment of the invention, a dual track device provides synergistic options for performing exercise which cannot be performed using a single track device, for example training two of a user's limbs simultaneously or performing exercises that require interaction between two users, which are each using one of the tracks or sharing tracks.

Figure 8:
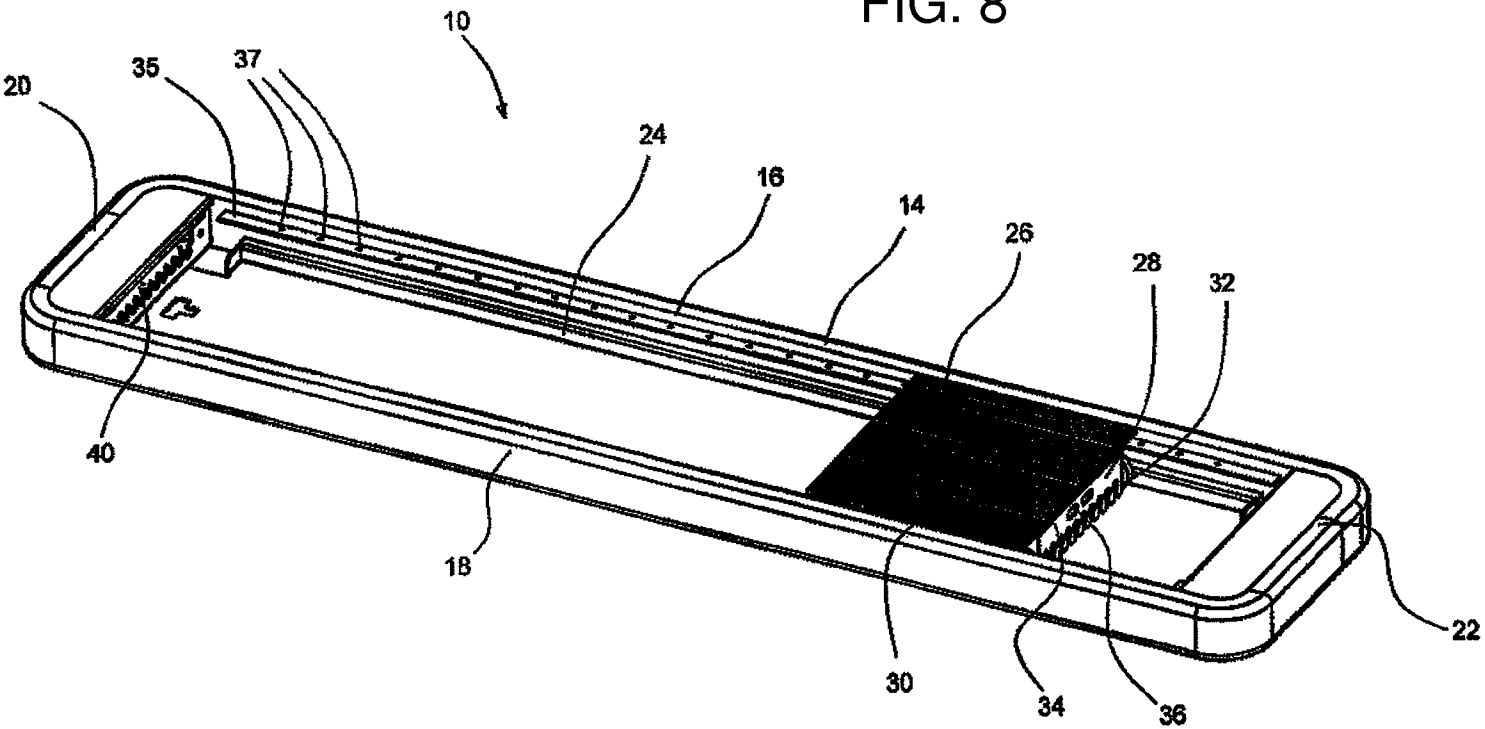
FIG. 8 is a perspective view of a preferred embodiment of a single track exercise device in accordance with the present disclosure.

Reference is now made to FIG. 8, which is a perspective view of a preferred embodiment of a single track exercise device. The device, generally referred to as 10, comprises a rigid frame 14 of a substantially rectangular shape, having two opposite sides 16, 18, and two opposite ends 20, and 22; a first track rail 24 running between ends 20 and 22 of the frame, in parallel to sides 16 and 18 of frame 14; a second track rail 25 (see FIG. 9C) running in parallel to track rail 24; and a platform, generally referenced as 26 which moves along the tracks. Track rails 24 and 25 can run all the way from end wall 20 to wall 22, or be shorter, and only reach the vicinity of walls 20 or 22. Track rails 24 and 25 can be attached to walls 16 and 18, or run a short distance away from them.

Platform 26 comprises a frame 28, a flat top panel 30 mounted on frame 28, wheels 32, and a sequence of platform attaching elements, such as sequence of keyhole-like recesses 34 (best seen in FIG. 2A), wherein each keyhole-like recesses 34 is an attaching element. In accordance with the embodiment shown here, platform 26 is symmetric, and comprises four wheels 32, and two opposite sequences of keyhole openings as shown in FIG. 9A. Tracks 24 and 25 are further detailed in association with FIG. 9C below. When the device is used, wheels 32 roll inside track rails 24 and 25, thus moving platform 26 in parallel to walls 16 and 18 of frame 14. Since track rail 24 comprises a top cover 272 of FIG. 9C, wheels 32 are protected, so that the platform is not accidentally hurled from the tracks if the user activates unbalanced weight on an edge of platform 26. On, or in the vicinity of ends 20 and 22 of frame 14, frame 14 further comprises two sequences of frame attaching elements, such as panels provided with a sequence of keyhole-like recesses 40 (only the sequence for end 20 is seen in FIG. 8), which can connect to platform keyhole sequences of the platform via resistance mediums.

Frame 14 is preferably made of metal, wood, or any other rigid material. Preferably, the dimensions of the frame are of about 30 to 60 cm wide and of about 2 m long so as to allow an adult a comfortable standing with both feet between sides 16, 18 and a full, or nearly full straddling of both legs between ends 20, 22. However, the dimensions of the device are independent of its structure, so a person skilled in the art will appreciate that larger and smaller devices can be designed using the disclosed invention. The tracks are preferably made of rigid material, such as an aluminum profile, iron, titanium or the like.

Frame 28 and top panel 30 of platform 26 are also made of rigid material, so that the platform can bear the weight of an adult. Top panel 30 is preferably padded with a softer layer, such as rubber, in order to avoid knee and back damage from a user and provide traction for added user safety. The platform is preferably a few centimeters narrower than the frame, and should be long enough to allow an adult to fully position his foot on the platform. Platform 26 further comprises holes 36 on either side, for allowing the user to insert his fingers in order to grip the platform while inserting and removing wheels 32 into and from track rails 24 and 25.

Referring now to FIGS. 9A and 9B, showing in more detail the structure of resistance mediums and platform 140 of FIG. 1 and platform 26 of FIG. 8. Platform 26 (140) comprises generally rectangular frame 28, four wheels 32, each connected to frame 28 and rotating around axis 234. Two opposite sides of platform 26, 140, are provided with a sequence 34A and 34B of recesses serving as attaching elements for connecting platform 26, 140 to ends 20, 22 of frame 14 of FIG. 8 by means of resistance mediums. Sequence 34 typically comprises between 2 and 15 recesses, each having a neck 236 and a wider area, to enable the user multiple choice of resistance mediums when using the device. Neck 238 is typically 2 to 8 mm wide and 2 to 30 mm long, and wider area 242 is generally circular, with a diameter of about 3 to 15 mm. The resistance medium, generally referred to as 250, comprises band 254, preferably made of elastic material or structure such as rubber, metal springs or the like. With little or no tension, the length of each band is designed to be about the same as the distance between the two platform keyhole sequences 34A and 34B of platform 26. The diameter of band 254 is typically between 1 and 15 mm. Medium 250 further comprises on each end a conic terminator, preferably made of metal or another rigid material. In order to hold the tip of band 254 from slipping out of terminator 258, a bead made of rigid or semi-rigid substance 262 is threaded and fastened on band 254. Bead 262 is preferably coated by a soft layer to prevent abrasion and tearing of band 254. It will be appreciated by people skilled in the art that other embodiments for medium 250 can be designed and used. In order to connect or release medium 250 from the platform, either for usage or for storing, the user pushes band 250 through neck 238 to wider part 242 and releases. Conic terminator 258 fixates the medium and prevents it from pulling back. When the resistance mediums are not used, they are stored inside platform 26 (140) as shown in FIG. 9A.

FIG. 9A shows platform 26 with a multiplicity of resistance mediums 250 in a storage position, having bands 254 extending between opposite walls of the platform and terminators 258 protruding outwardly through recess sequences 34A and 34B. Since the equilibrium length of the mediums is about the same as or shorter than the distance between two platform keyhole sequences 34, the mediums do not entangle or touch the floor or the bottom part of the device.

FIG. 9B is a bottom perspective view of the platform, frame and resistance medium during use. During use, platform 26 is connected to keyhole sequences 40A and 40B of frame 14, using two sets of resistance mediums, 262 and 264. Resistance mediums 262 connect the right sequence 34B of platform 26 to the left sequence 40A of frame 14, while resistance mediums 264 connect the left sequence 34A of platform 26 to the right sequence 40B of frame 14. This connection manner is convenient, since for each resistance medium to be used, the user only has to pull one end of the stored resistance medium from the platform and connect it to the frame, without having to release the other end of the resistance medium from the platform. Alternatively, if the user wishes, it is possible to place the resistance mediums so that they connect each side of the platform with the closer side of the frame, i.e., connect keyhole sequences 34A and 40A, or connect keyhole sequences 34B and 40B. In yet another alternative, the resistance mediums can connect two platforms used on the same track system.

FIG. 9C shows a cross section through track rail 24, the platform 26, and second track rail 25. Track rails 24 and 25 comprise upper covers 272 and 274, respectively. Upper cover 272 partly covers wheels 32A, so that platform 26 is prevented from bouncing when imbalanced weight is activated. Track rail 25 preferably comprises vertical wall 266 to protect and direct the two wheels that roll in track rail 25, and prevent the platform from moving sideways. Track rail 24 preferably comprises a vertical wall 268 to protect and direct the two wheels that roll within track rail 24. In order to remove the platform from the track, a user needs to raise the platform in an angle from the side of track 25. For the user's safety, this operation is disabled on the side of track 24, due to cover 272 protecting wheels 32A. Optionally, platform 26 is featured with an L shaped rotatable hook, comprising a vertical part 269A and a horizontal part 269B. When the device is used, the hook is turned perpendicularly to the direction in which the platform moves along the tracks, so that the end of horizontal part 269B is positioned under cover 274, without getting in contact with cover 274, so the motion of platform 26 along the tracks is not interrupted. When the user wishes to remove the platform, he or she first has to rotate the hook in 90° around: vertical part 269A, so that the end of horizontal part 269B is not under cover 274, and then proceed in removing as detailed above. This mechanism is designed to provide additional security, and further avoid hurling of the platform form the tracks. Track rails 24 and 25 are preferably manufactured such that horizontal part 267, which constitutes the lower part of track rail 24 comprises the bottom of the device. Track rails 24 and 25 may be manufactured as shown in FIG. 9C, but other profile combinations can be designed as well.

Figure 2:
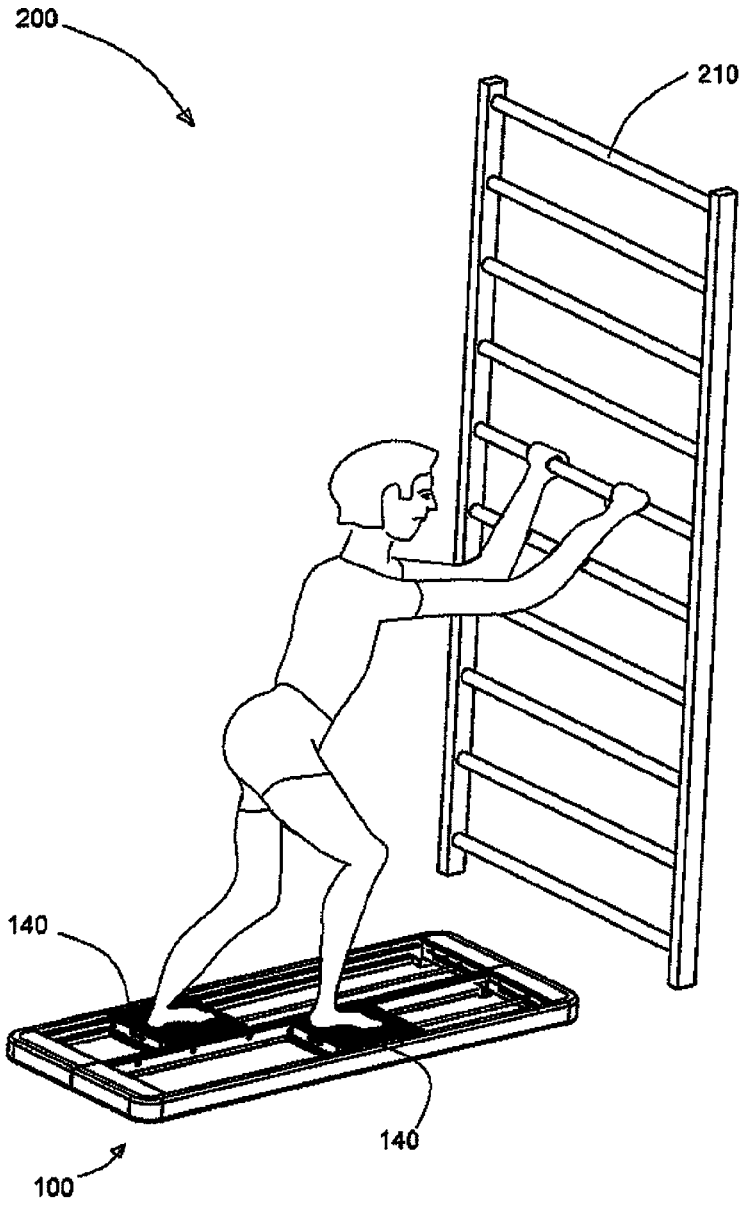
FIG. 2 is a schematic illustration of the deployment and usage of an exercise device with two tracks, according to an exemplary embodiment of the invention.

In an exemplary embodiment of the invention, a user exerts forces on one or more of platforms 140 that are deployed on tracks 120 and 130 in order to perform exercises. FIG. 2 is a schematic illustration 200 of the deployment and usage of an exercise device with two tracks, according to an exemplary embodiment of the invention. In an exemplary embodiment of the invention, a user may stand with one leg on platform 140 of track 120 and one leg on platform 140 of track 130. Optionally, the user holds on to an external apparatus, for example a ladder 210 as shown in FIG. 2, while moving his or her legs back and forth with platforms 140. It should be noted that there is no interaction between platforms 140 on the two tracks and the freedom of motion of platform 140 on each track and/or direction of resistance is controlled independently according to the constraints applied to the specific platform, for example level of friction between platform 140 and the track, the freedom of motion of the gears or wheels, and strength of the elastic rope or spring limiting the motion of the platform. Optionally, both platforms 140 may have an equal level of freedom of motion. Alternatively, one platform 140 may be set to require more force than the other to perform the same motion. In some embodiments of the invention, the required force is controllable for each platform, for example by connecting or disconnecting more constraints (e.g. more springs, or stronger springs).

Figure 3:
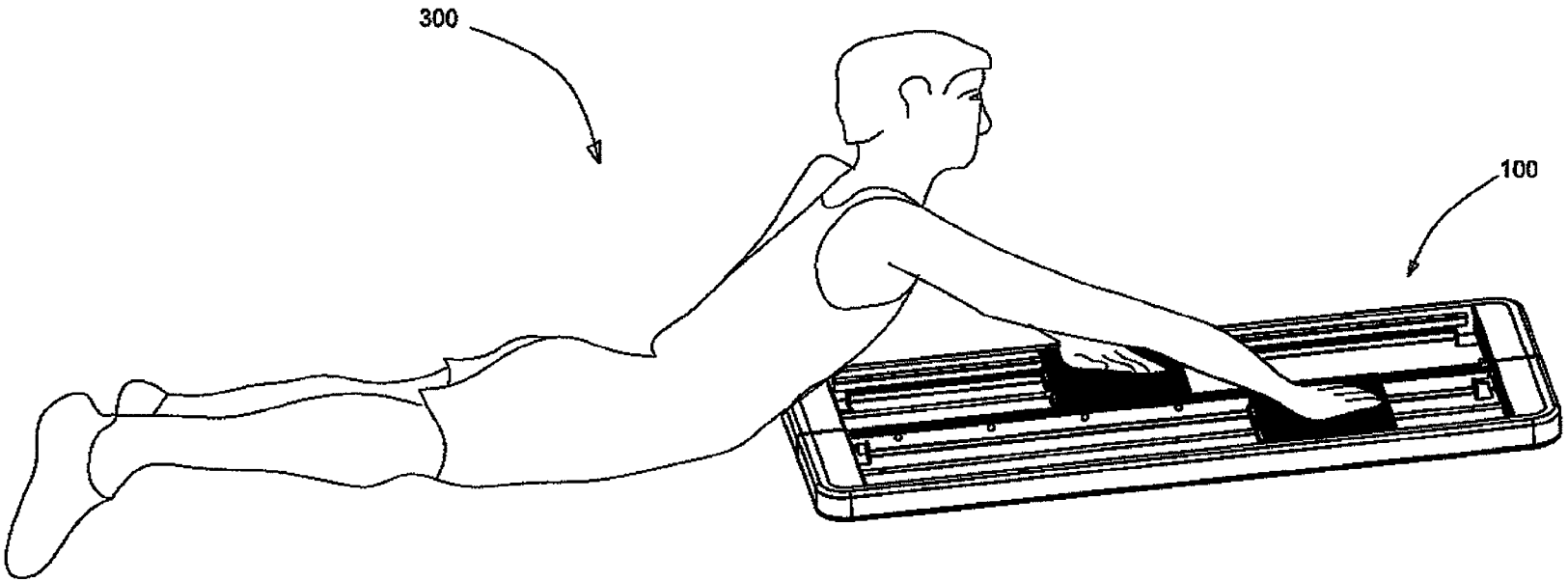
FIG. 3 is a schematic illustration of an alternative use of an exercise device with two tracks, according to an exemplary embodiment of the invention.

FIG. 3 is a schematic illustration 300 of an alternative use of an exercise device with two tracks, according to an exemplary embodiment of the invention. Illustration 300 shows a user exercising both hands simultaneously by exerting force on platforms 140 of tracks 120 and 130. As mentioned above regarding FIG. 2, the amount of resistance of each, and direction of resistance of each platform 140 relative to its track is optionally, separately controllable.

Figure 4:
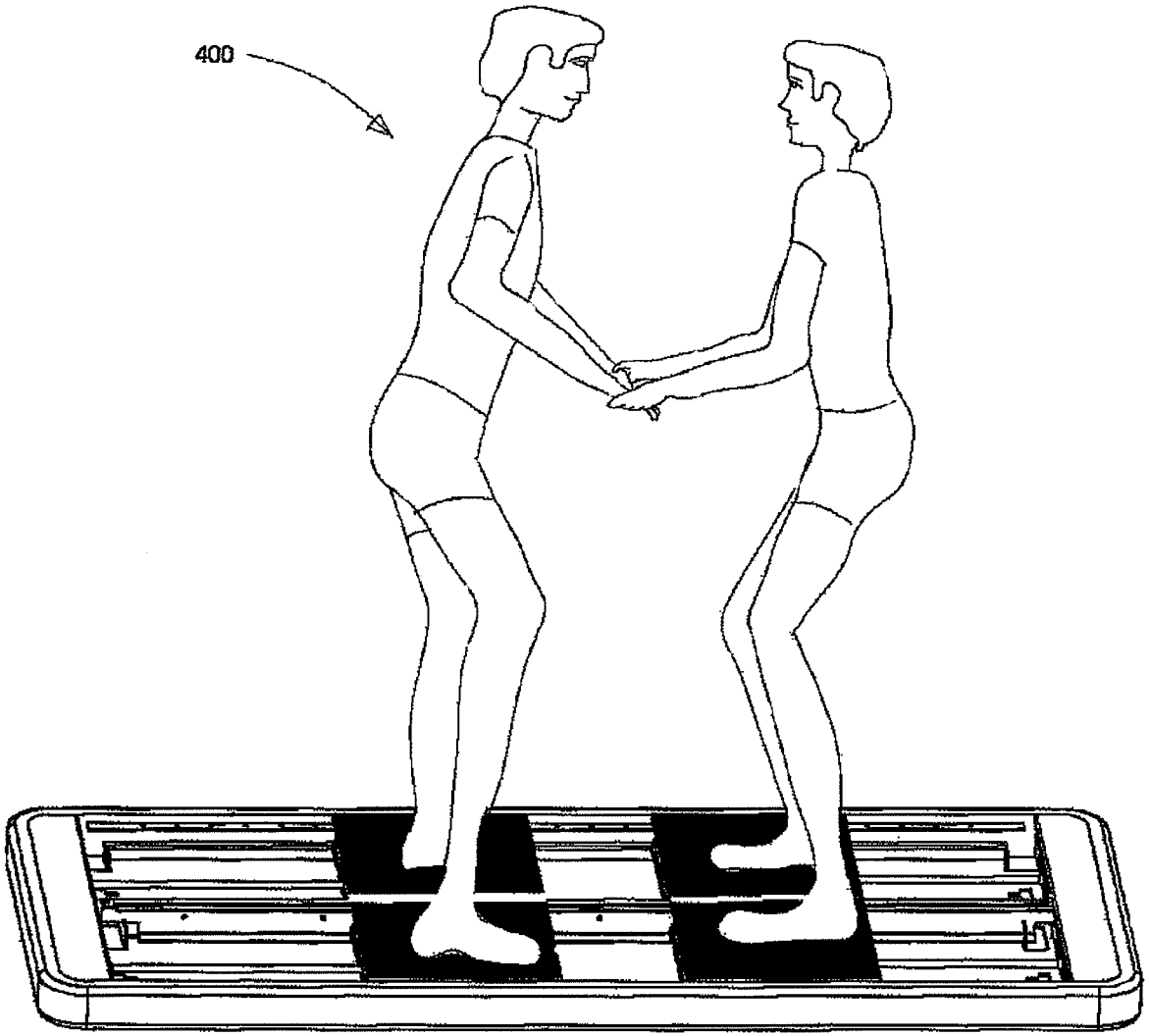
FIG. 4 is a schematic illustration of usage of an exercise device with two tracks by two users, according to an exemplary embodiment of the invention.

FIG. 4 is a schematic illustration 400 of usage of an exercise device with two tracks by two users, according to an exemplary embodiment of the invention. In some embodiments of the invention, each track (120, 130) serves as an exercise device for a single user. Optionally, the users set exercise device 100 as desired or required to perform exercise with interaction between them, for example both tracks 120, 130 may be set with an identical constraint or different constraints on platforms 140 and the users may support each other or oppose each other by holding hands or interacting in other ways.

Figure 5:
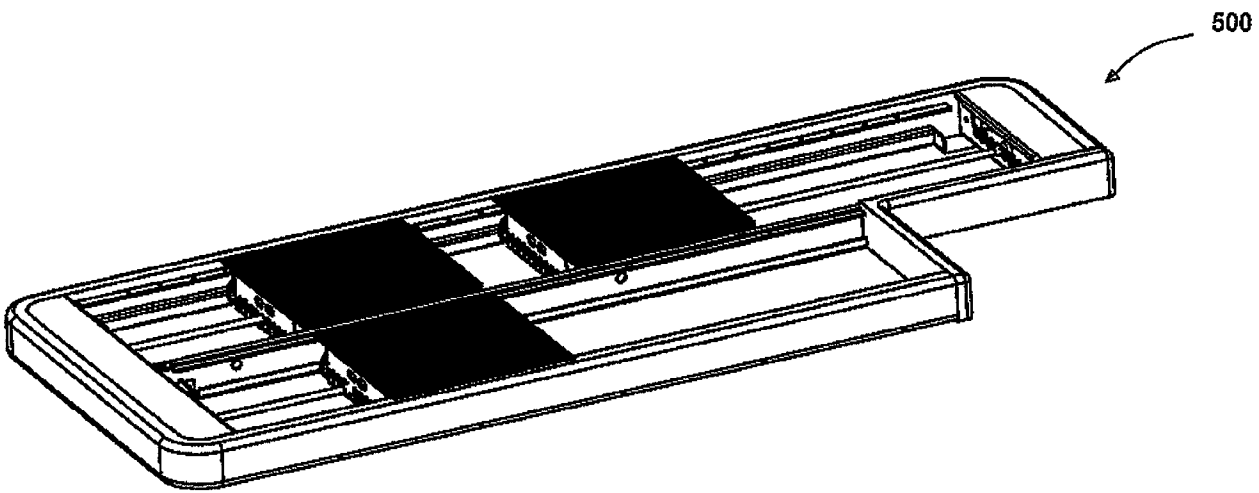
FIG. 5 is a schematic illustration of an exercise device with two tracks of different length, according to an exemplary embodiment of the invention.

FIG. 5 is a schematic illustration of an exercise device 500 with two tracks of different length, according to an exemplary embodiment of the invention. In some embodiments of the invention, one of the tracks may serve for certain types of exercise or certain limbs while the other track may serve for other types of exercise or different limbs. Alternatively or additionally, the two tracks may differ in width or be comprised from a different exercise device. In some embodiments of the invention, one of the tracks may comprise more than one platform (e.g. 2 as shown in FIG. 5).

Figure 6:
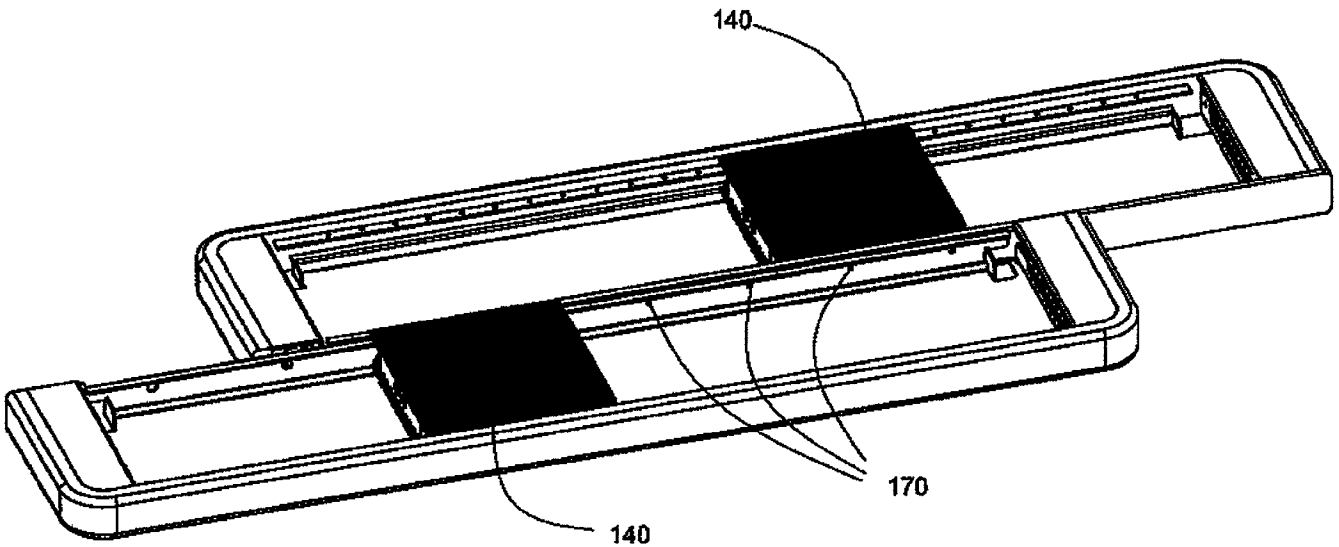
FIG. 6 is a schematic illustration of an exercise device with two tracks positioned with an offset between their end points, according to an exemplary embodiment of the invention.

FIG. 6 is a schematic illustration of an exercise device 600 with two tracks positioned with an offset between their end points, according to an exemplary embodiment of the invention. In an exemplary embodiment of the invention, two identical tracks or tracks that differ in shape, for example length and/or width may be combined with an offset between their end points along their longitudinal axis. Optionally, by combining two tracks with an offset and/or that differ in shape, further methods of muscle training may be implemented by one or two users.

Figure 7:
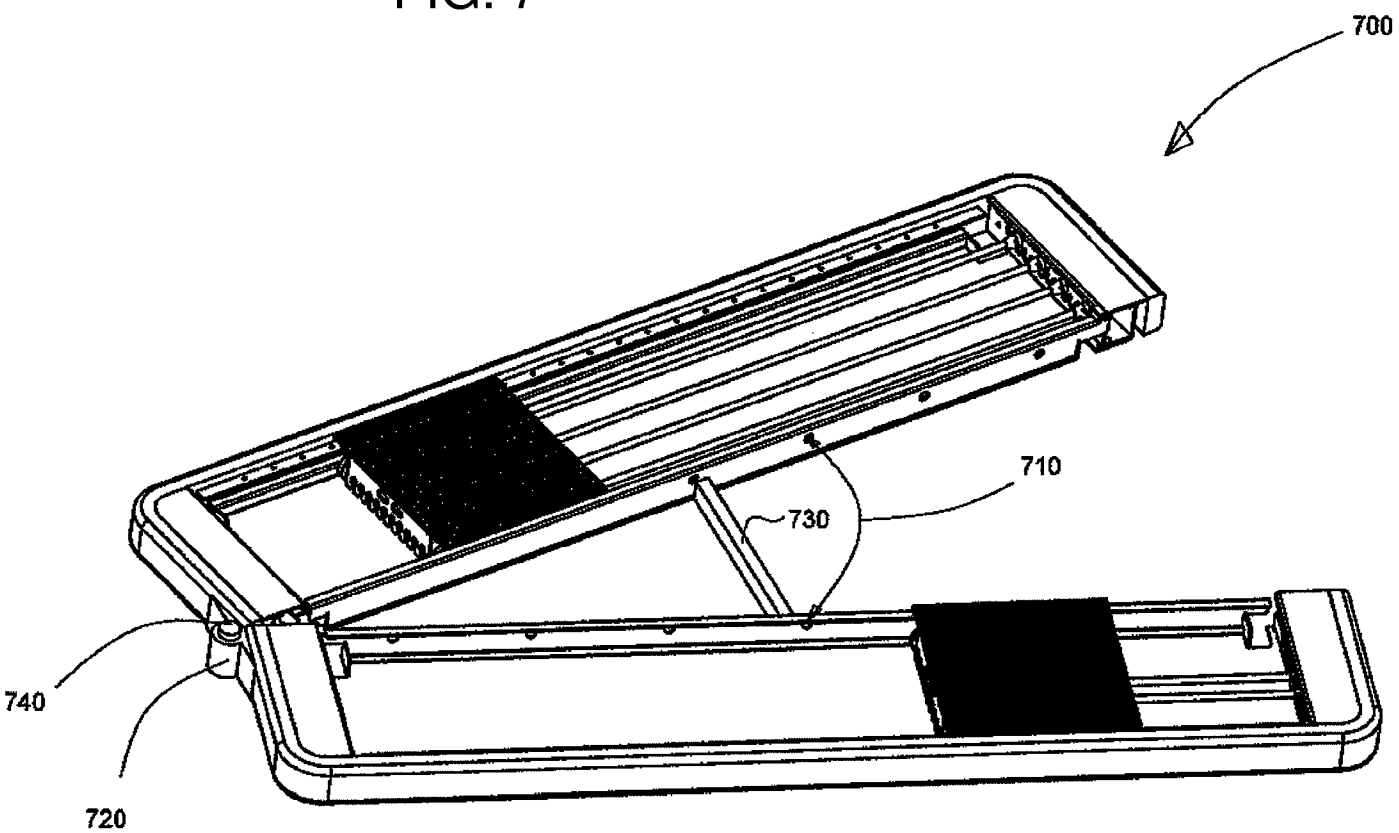
FIG. 7 is a schematic illustration of an exercise device with two tracks forming an angle between the directions that the tracks extend, according to an exemplary embodiment of the invention.

FIG. 7 is a schematic illustration of an exercise device 700 with two tracks forming an angle 710 between the directions that the tracks extend, according to an exemplary embodiment of the invention. In some embodiments of the invention, the two tracks are connected with a pre-selected angle between them. Alternatively, the two tracks are connected by a hinge 720 with a pivot pin 740. In an exemplary embodiment of the invention, hinge 720 allows the two tracks to rotate relative to each other forming angle 710 between them. Optionally, exercise device 700 allows selecting any angle or specific angles between the two tracks. In an exemplary embodiment of the invention, a stick 730 is connected between the two tracks (120, 130) to prevent a change in the angle between the two tracks.

In an exemplary embodiment of the invention, many exercises may readily be designed for optimally training selected muscles using a two track device in various forms such as described above.

It should be appreciated that the above described methods and apparatus may be varied in many ways, including omitting or adding steps, changing the order of steps and the type of devices used. It should be appreciated that different features may be combined in different ways. In particular, not all the features shown above in a particular embodiment are necessary in every embodiment of the invention. Further combinations of the above features are also considered to be within the scope of some embodiments of the invention.

Section headings are provided for assistance in navigation and should not be considered as necessarily limiting the contents of the section.

It will be appreciated by persons skilled in the art that the present invention is not limited to what has been particularly shown and described hereinabove. Rather the scope of the present invention is defined only by the claims, which follow.

What is claimed is:

1. A portable device for performing exercises, comprising:

two independent tracks with a physical connection between them, each track having a first end and a second opposite end;

a pair of movable platforms, one platform on each track, each platform being selectively connectable to both first and second ends by one or more elastic members, wherein each platform has a first attachment element and an opposing second attachment element extending downward from opposite ends of the platform in a spaced apart relation, each of the first and second attachment elements having a series of spaced openings therethrough, wherein the elastic members are mounted beneath each platform to and straight between the first and second spaced attachment elements through the openings, each elastic resistance member having one end connectable to the first attachment element through one of the openings and a second end connectable to the second element through another one of the openings when the resistance member is not in use; and each end of any one of the elastic resistance members is configured to be removably pulled further through the one of the first or second attachment elements in one direction and fastened to an end of the track closest to the platform element through which the end of the elastic member has been pulled, and wherein at least one other elastic member is configured to be removably passed through the other one of the first or second attachment elements in an opposite direction and fastened to the end of the frame closest to the other one of the first or second elements such that the platform can be neutrally positioned between the opposite ends of the tracks.

2. A device according to claim 1, wherein each of said tracks includes two parallel rails upon which the platform rides and wherein the tracks are connected parallel to each other.

3. A device according to claim 2, wherein said tracks are connected with an offset between their starting points along their longitudinal axis.

4. A device according to claim 1, wherein said tracks have the same length.

5. A device according to claim 1, wherein said tracks differ in length.

6. A device according to claim 1, wherein said tracks form an angle greater than zero relative to each other.

7. A device according to claim 1, wherein the platforms are adapted to glide over said tracks.

8. A device according to claim 1, wherein the platforms comprise wheels to move on said tracks.

9. A device according to claim 1, wherein the track length available for each platform to move on is selectable.

10. A device according to claim 1, wherein the track length available to each platform may be set to zero.

11. A device according to claim 1, further comprising more than one platform on at least one track.

12. A device according to claim 1, wherein each track is encased in a frame.

13. A device according to claim 12, wherein said frame comprises a widened area that is wide enough for a user to place a foot.

14. A device according to claim 1, wherein both tracks are encased in one frame.

15. A portable exercise device comprising:

a frame;

two independent tracks attached to the frame, each track having a first end and a second opposite end;

a pair of movable platforms positioned side by side in the frame, with one platform riding on each track, each platform being selectively connectable by a user to both first and second ends of its track by two or more resistance mediums;

wherein each platform carries at least one resistance medium having one end connectable to the platform and a second end connectable to one of the first and second ends of the frame and at least one other resistance medium having one other end connectable to the platform and the other end connectable to the other one of the ends of the frame to neutrally position the platform between the ends;

wherein each resistance medium is stored under and carried by the platform, in parallel to a top panel of the platform when not in use, and wherein the platform is provided with two spaced apart platform frame members extending downward from opposite ends of the platform, each frame member having a sequence of keyhole shaped platform attaching elements in the form of keyhole shaped openings, and wherein each resistance medium passes straight through both of the platform frame members and has an equilibrium length equal or shorter than the distance between the two spaced apart sequences to allow storage of each resistance medium beneath the platform by connecting one end of each of the resistance mediums to an attaching element of one of the two sequences of platform attaching elements and the other end of each of the resistance mediums to another attaching element of the other sequence of platform attaching elements; and wherein each end of any one of the resistance mediums is configured to be removably pulled further through the one of the first or second attachment elements in one direction and fastened to an end of the track closest to the platform element through which the end of the resistance medium has been pulled, and wherein at least one other resistance medium is configured to be removably passed through the other one of the first or second attachment elements in an opposite direction and fastened to the end of the frame closest to the other one of the first or second elements such that the platform can be neutrally positioned between the opposite ends of the track.

16. The device according to claim 15 wherein the resistance mediums are selected from the group consisting of springs, elastic cords, elastic ropes and elastic bands.

17. An exercise device comprising:

a frame having two opposite ends and two tracks each extending between the ends of the frame, two platforms movably mounted on the tracks such as to allow movement of the platforms between the opposite ends of the frame; and at least one resistance medium having one end connectable to one of the two platforms and a second end connectable to one of said two opposite ends of the frame and at least one other resistance medium having one other end connectable to the one platform and a second other end connectable to the other one of said two opposite ends of the frame such that the one platform is neutrally positioned between the opposite ends when the mediums are connected between the one platform and the ends of the frame, wherein each of the platforms is provided with two spaced apart sequences of platform attaching elements, and wherein each resistance medium has an equilibrium length equal or shorter than the straight distance between the two spaced apart sequences to allow storage of each resistance medium beneath its platform by connecting one end of each of the resistance mediums to an attaching element of one of the two sequences of platform attaching elements and the other end of each of the resistance mediums to another attaching element of the other sequence of platform attaching elements.

18. The device of claim 17 wherein each track has a cover and each platform rides on a different one of the tracks.

19. The device of claim 17 wherein the tracks are parallel.

20. The device of claim 17 wherein each resistance medium is stored under its platform in parallel to a top panel of that platform, when not in use.

21. The device of claim 17 wherein each resistance medium is a stretchable elastic cord.

22. The device of claim 17 wherein each resistance medium includes an elongated elastic member having opposite ends and a rigid conic shaped terminator fastened to each end of the elastic member.

23. The device of claim 17 wherein each of the platforms has a set of wheels for moving the platform along the frame between the ends.

24. The device according to claim 17 wherein at least one of the tracks comprises a cover, said cover at least partially covering at least one part of the one of the two platforms.

25. The device of claim 24 wherein the cover extends over one or more of the wheels to prevent inadvertent removal of the platform from the track on which the platform is mounted.

26. An exercise device according to claim 24 wherein each end of each resistance medium may be removably pulled further through the one of the first or second elements and fastened to an end of the frame closest to the platform element through which the end of the resistance medium has been pulled, and wherein at least one other resistance medium is removably passed through the other one of the first or second elements and fastened to the end of the frame closest to the other one of the first or second elements such that the platform can be neutrally positioned between the opposite ends of the frame when two or more resistance mediums are connected between the platform and the ends of the frame.

* * * * *